US011510435B1

(12) United States Patent
Parker

(10) Patent No.: US 11,510,435 B1
(45) Date of Patent: Nov. 29, 2022

(54) BOWL FOR WATER PIPE HAVING MULTIPLE PARTITIONED COMPARTMENTS

(71) Applicant: William Parker, Durham, NC (US)

(72) Inventor: William Parker, Durham, NC (US)

( * ) Notice: Subject to any disclaimer, the term of this patent is extended or adjusted under 35 U.S.C. 154(b) by 245 days.

(21) Appl. No.: 16/253,282

(22) Filed: Jan. 22, 2019

(51) Int. Cl.
*A24F 1/30* (2006.01)
*A24F 5/00* (2006.01)

(52) U.S. Cl.
CPC . *A24F 1/30* (2013.01); *A24F 5/00* (2013.01)

(58) Field of Classification Search
None
See application file for complete search history.

(56) References Cited

U.S. PATENT DOCUMENTS

| | | | | |
|---|---|---|---|---|
| 682,278 | A | 9/1901 | Roller | |
| 4,171,703 | A * | 10/1979 | Locke | A24F 5/00 131/173 |
| 6,418,936 | B1 | 7/2002 | Lee | |
| D760,430 | S | 6/2016 | Hanna | |
| 9,974,331 | B2 | 5/2018 | Portz | |
| 2010/0101590 | A1 | 4/2010 | Pflaum | |
| 2016/0143352 | A1 | 5/2016 | Bavar | |

FOREIGN PATENT DOCUMENTS

| | | | |
|---|---|---|---|
| EP | 2179667 A1 * | 4/2010 | A24D 1/14 |
| WO | 2011002728 | 1/2011 | |

OTHER PUBLICATIONS

Shisha Works, "How to Pack a Hookah Bowl", Nov. 13, 2018, https://shishaworks.com.au/blogs/hookah-blog/how-to-pack-a-hookah-bowl (Year: 2018).*

* cited by examiner

*Primary Examiner* — Michael H. Wilson
*Assistant Examiner* — Katherine A Will
(74) *Attorney, Agent, or Firm* — Kyle A. Fletcher, Esq.

(57) ABSTRACT

The bowl for a water pipe having multiple partitioned compartments (hereinafter invention) is configured for use with a smoking material consumed through a hookah. The invention contains the smoking material during combustion. The combustion of the smoking material releases the pharmacologically active media in a gas phase. The invention is a partitioned structure. The invention is configured to store a plurality of doses of the smoking material. Each dose is stored in a partition. Each partition displays a scale that measures the dose of the smoking material contained in the partition. The invention comprises a partitioned bowl and a transport structure. The partitioned bowl is the partitioned structure that contains one or more doses of the smoking material. The transport structure forms a fluidic connection between the partitioned bowl and the hookah that transports the gas phase of the pharmacologically active media from the partitioned bowl to the hookah.

18 Claims, 4 Drawing Sheets

BOWL FOR WATER PIPE HAVING MULTIPLE PARTITIONED COMPARTMENTS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of tobacco including smoker's requisites, more specifically, a hookah. (A24F1/30)

SUMMARY OF INVENTION

The bowl for a water pipe having multiple partitioned compartments is configured for use with a hookah. The bowl for a water pipe having multiple partitioned compartments is configured for use with a smoking material. The bowl for a water pipe having multiple partitioned compartments contains the smoking material during a combustion process. The combustion of the smoking material releases the pharmacologically active media in a gas phase. The bowl for a water pipe having multiple partioned compartments is a partitioned structure. The bowl for a water pipe having multiple partitioned compartments is configured to store a plurality of doses of the smoking material. Each dose is stored in a partition. Each partition displays a scale used to measure the dose of the smoking material contained in the partition. The bowl for a water pipe having multiple partitioned compartments comprises a partitioned bowl and a transport structure. The partitioned bowl is the partitioned structure that contains one or more doses of the smoking material. The transport structure forms a fluidic connection between the partitioned bowl and the hookah that transports the gas phase of the pharmacologically active media from the partitioned bowl to the hookah.

These together with additional objects, features and advantages of the bowl for a water pipe having multiple partitioned compartments will be readily apparent to those of ordinary skill in the art upon reading the following detailed description of the presently preferred, but nonetheless illustrative, embodiments when taken in conjunction with the accompanying drawings.

In this respect, before explaining the current embodiments of the bowl for a water pipe having multiple partitioned compartments in detail, it is to be understood that the bowl for a water pipe having multiple partitioned compartments is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bowl for a water pipe having multiple partitioned compartments.

It is therefore important that the claims be regarded as including such equivalent construction insofar as they do not depart from the spirit and scope of the bowl for a water pipe having multiple partitioned compartments. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
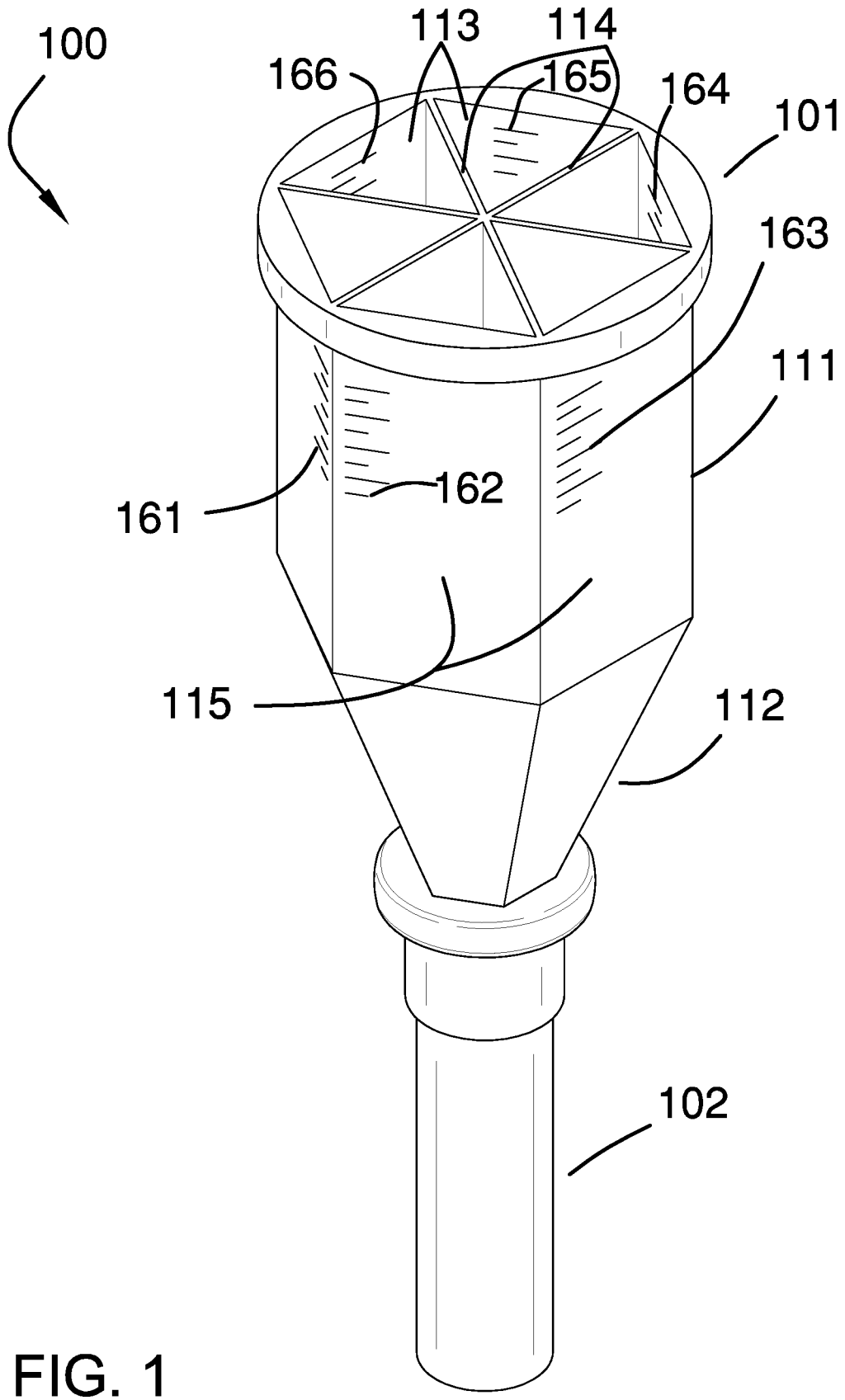
FIG. 1 is a perspective view of an embodiment of the disclosure
Figure 2:
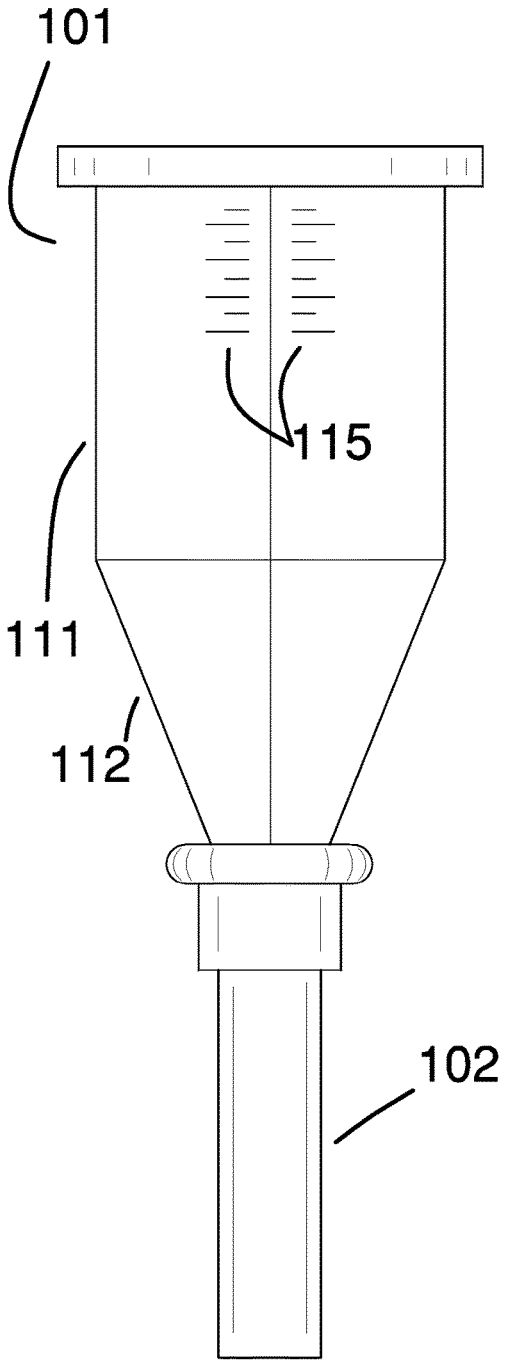
FIG. 2 is a front view of an embodiment of the disclosure.
Figure 3:
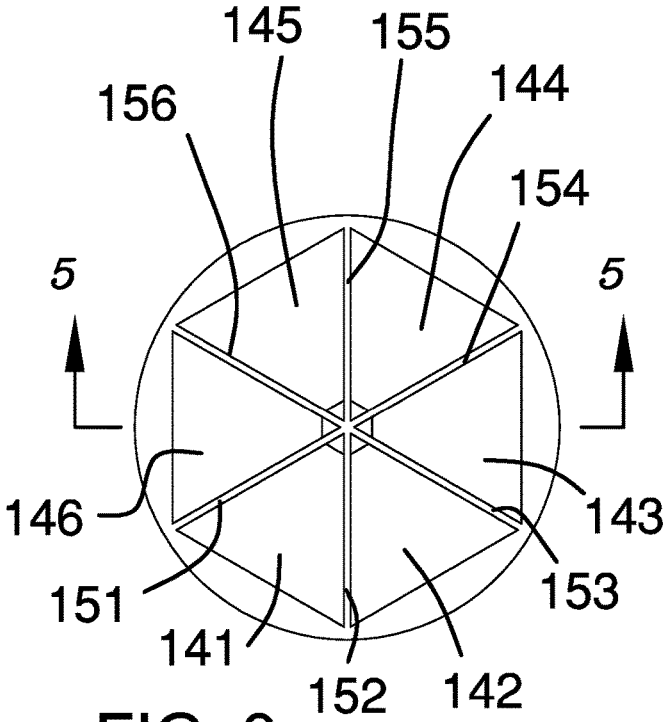
FIG. 3 is a top view of an embodiment of the disclosure.
Figure 4:
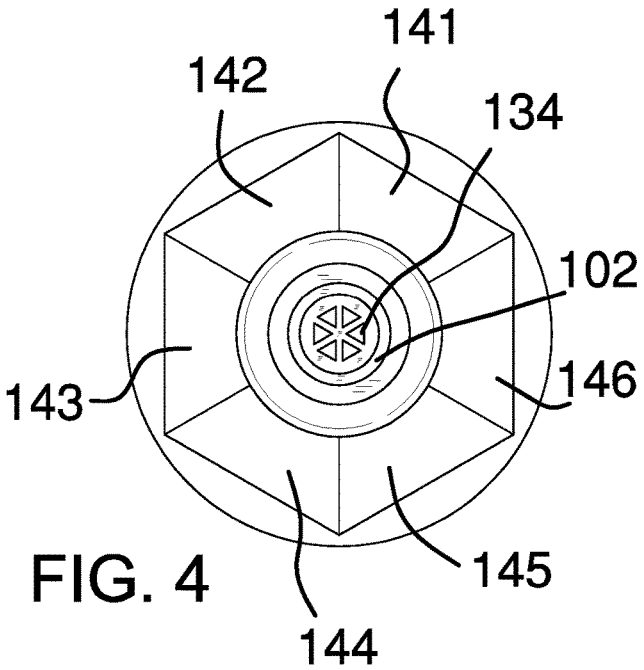
FIG. 4 is a bottom view of an embodiment of the disclosure.
Figure 5:
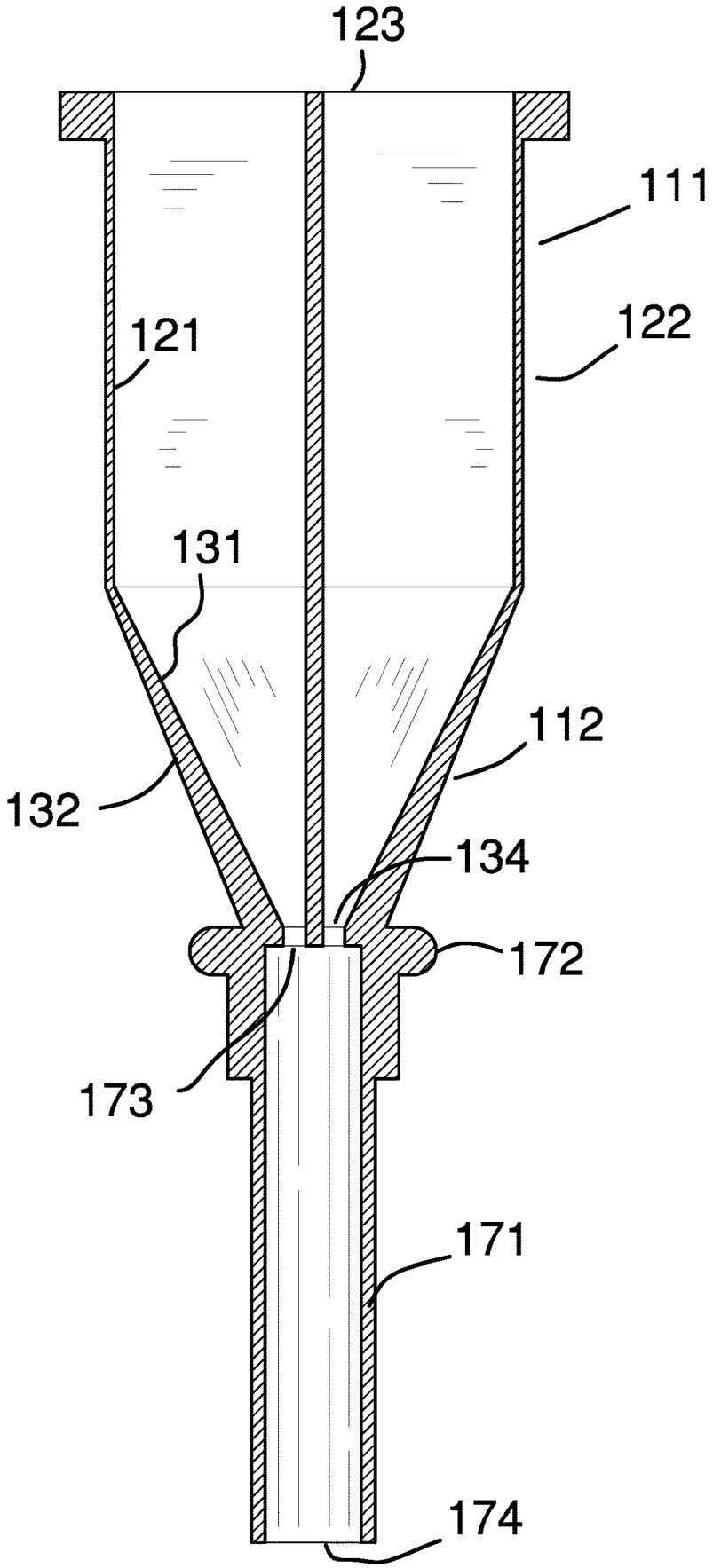
FIG. 5 is a cross-sectional view of an embodiment of the disclosure across 5-5 as shown in FIG. 3.
Figure 6:
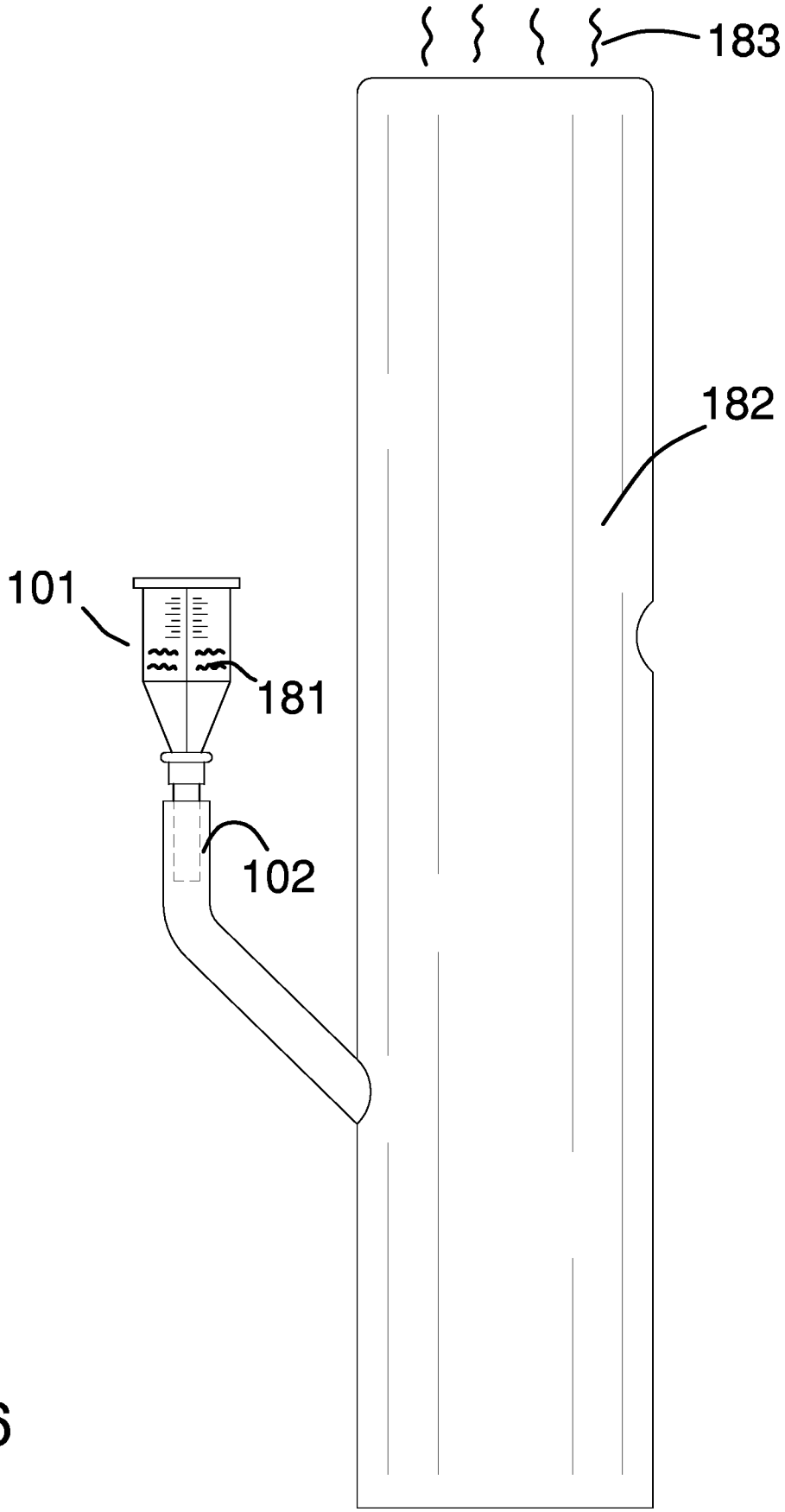
FIG. 6 is an in-use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

qDetailed reference will now be made to one or more potential embodiments of the disclosure, which are illustrated in FIGS. 1 through 6.

The bowl for a water pipe having multiple partitioned compartments 100 (hereinafter invention) is configured for use with a hookah 182. The invention 100 is configured for use with a smoking material 181. The invention 100 contains the smoking material 181 during a combustion process. The combustion of the smoking material 181 releases the pharmacologically active media in a gas phase 183. The invention 100 is a partitioned structure. The invention 100 is configured to store a plurality of doses of the smoking material 181. Each dose is stored in a partition. Each partition displays a scale used to measure the dose of the smoking material 181 contained in the partition. The invention 100 comprises a partitioned bowl 101 and a transport structure 102. The partitioned bowl 101 is the partitioned structure that contains one or more doses of the smoking material 181. The transport structure 102 forms a fluidic connection between the partitioned bowl 101 and the hookah 182 that transports the gas phase of the pharmacologically active media 183 from the partitioned bowl 101 to the hookah 182.

The smoking material 181 is defined elsewhere in this disclosure. The hookah 182 is defined elsewhere in this disclosure. The gas phase of the pharmacologically active media 183 is defined elsewhere in this disclosure.

The partitioned bowl 101 is a hollow structure. The partitioned bowl 101 has the shape of a composite prism. The partitioned bowl 101 contains the smoking material 181 for storage. The partitioned bowl 101 contains the smoking material 181 during the combustion process that releases the gas phase of the pharmacologically active media 183. Each of the partitions formed within the partitioned bowl 101 forms a partitioned storage space such that the smoking material 181 can be segregated into a plurality of independently stored doses. Each separate dose contained in the partitioned bowl 101 can be consumed independently of other independent doses contained within the partitioned bowl 101.

The partitioned bowl 101 comprises a prism structure 111, a pyramid structure 112, and a plurality of bulkheads 114. The prism structure 111 is further defined with a prism interior surface 121, a prism exterior surface 122, a prism intake port 123, and a prism exhaust port 124. The pyramid structure 112 is further defined with a pyramid interior surface 131, a pyramid exterior surface 132, a pyramid intake port 133, and a pyramid exhaust port 134.

The prism interior surface 121 refers to the interior surface of the lateral face of the structure that forms the prism structure 111. The prism exterior surface 122 refers to the exterior surface of the lateral face of the structure that forms the prism structure 111. The prism intake port 123 refers to a first open end of the prism structure 111. The atmospheric gas drawn into the hookah 182 enters the invention 100 through the prism intake port 123. The prism intake port 123 is the end of the prism structure 111 that is distal from the pyramid structure 112. The prism exhaust port 124 refers to a second open end of the prism structure 111. The atmospheric gas drawn through the prism structure 111 is discharged into the pyramid structure 112 through the prism exhaust port 124. The prism exhaust port 124 is the end of the prism structure 111 that attaches to the pyramid structure 112.

The pyramid interior surface 131 refers to the interior surface of the lateral face of the structure that forms the pyramid structure 112. The pyramid exterior surface 132 refers to the exterior surface of the lateral face of the structure that forms the pyramid structure 112. The pyramid intake port 133 refers to the open base of the pyramid structure 112. The atmospheric gas drawn into the hookah 182 enters the pyramid structure 112 through the pyramid intake port 133. The pyramid intake port 133 is the end of the pyramid structure 112 that attaches to the prism exhaust port 124 of the prism structure 111. The pyramid exhaust port 134 refers to the open truncated apex of the truncated pyramid shape of the pyramid structure 112. The pyramid intake port 133 of the pyramid structure 112 is geometrically identical to the prism exhaust port 124 of the prism structure 111.

The atmospheric gas drawn through the pyramid structure 112 is discharged into the transport structure 102 through the pyramid exhaust port 134. The pyramid exhaust port 134 is the end of the pyramid structure 112 that is distal from the prism structure 111.

The prism structure 111 is a hollow prism-shaped structure. The prism structure 111 forms a fluid flow structure that transports atmospheric gases into the pyramid structure 112. In the first potential embodiment of the disclosure, the prism structure 111 has the shape of a hexagonal polygon. The prism structure 111 and the pyramid structure 112 are joined to form a composite prism shape.

The pyramid structure 112 is a hollow structure. The pyramid structure 112 has the shape of a truncated pyramid. The pyramid structure 112 forms a fluid flow structure that transports atmospheric gases from the prism structure 111 to the transport structure 102. In the first potential embodiment of the disclosure, the shape of the base of the pyramid structure 112 has the shape of the hexagonal polygon.

Each of the plurality of bulkheads 114 is a plate. Each of the plurality of bulkheads 114 forms a plane that contains the center axis of the composite prism that forms the partitioned bowl 101. Each of the plurality of bulkheads 114 forms a fluid impermeable barrier that extends from the center axis of the partitioned bowl 101 to the prism interior surface 121 of the prism structure 111. Each of the plurality of bulkheads 114 forms a fluid impermeable barrier that extends from the center axis of the partitioned bowl 101 to the pyramid interior surface 131 of the pyramid structure 112. Each of the plurality of bulkheads 114 forms a solid surface such that any two adjacent bulkheads selected from the plurality of bulkheads 114 isolate a chamber selected from the plurality of chambers 113 from the chambers remaining in the plurality of chambers 113. The plurality of bulkheads 114 forms a plurality of chambers 113 within the partitioned bowl 101.

Each of the plurality of chambers 113 is a segregated storage space formed in the partitioned bowl 101. Each of the plurality of chambers 113 stores a dose of the smoking material 181. Each of the plurality of chambers 113 contains the dose of the smoking material 181 during the combustion process used to release the gas phase of the pharmacologically active media 183. Each of the plurality of chambers 113 is bounded by the prism interior surface 121, the pyramid interior surface 131 and two adjacent bulkheads selected from the plurality of bulkheads 114. The construction of each of the plurality of chambers 113 is such that each dose of the smoking material 181 consumed independently while the remaining doses of the smoking material 181 remain in storage.

Each of the plurality of chambers 113 further comprises a plurality of scales 115. Each of the plurality of scales 115 is a calibrated set of markings. There is a one to one correspondence between each scale selected from the plurality of scales 115 and an associated chamber selected from the plurality of chambers 113. Each of the plurality of scales 115 provides a volumetric measure the dose of the smoking material 181 contained within the associated chamber.

The plurality of bulkheads 114 comprises a first bulkhead 151, a second bulkhead 152, a third bulkhead 153, a fourth bulkhead 154, a fifth bulkhead 155, and a sixth bulkhead 156.

The first bulkhead 151 is the bulkhead selected from the plurality of bulkheads 114 that forms a barrier between the sixth chamber 146 and the first chamber 141. The second bulkhead 152 is the bulkhead selected from the plurality of bulkheads 114 that forms a barrier between the first chamber 141 and the second chamber 142. The third bulkhead 153 is the bulkhead selected from the plurality of bulkheads 114 that forms a barrier between the second chamber 142 and the third chamber 143. The fourth bulkhead 154 is the bulkhead selected from the plurality of bulkheads 114 that forms a barrier between the third chamber 143 and the fourth chamber 144. The fifth bulkhead 155 is the bulkhead selected from the plurality of bulkheads 114 that forms a barrier between the fourth chamber 144 and the fifth chamber 145. The sixth bulkhead 156 is the bulkhead selected from the plurality of bulkheads 114 that forms a barrier between the fifth chamber 145 and the sixth chamber 146.

The plurality of chambers 113 comprises a first chamber 141, a second chamber 142, a third chamber 143, a fourth chamber 144, a fifth chamber 145, and a sixth chamber 146.

The first chamber 141 is the chamber selected from the plurality of chambers 113 located between the sixth chamber 146 and the second chamber 142. The second chamber 142 is the chamber selected from the plurality of chambers 113 located between the first chamber 141 and the third chamber 143. The third chamber 143 is the chamber selected from the plurality of chambers 113 located between the second chamber 142 and the fourth chamber 144. The fourth chamber 144 is the chamber selected from the plurality of chambers 113 located between the third chamber 143 and the fifth chamber 145. The fifth chamber 145 is the chamber selected from the plurality of chambers 113 located between the fourth chamber 144 and the sixth chamber 146. The sixth chamber 146 is the chamber selected from the plurality of chambers 113 located between the fifth chamber 145 and the first chamber 141.

The plurality of scales 115 comprises a first scale 161, a second scale 162, a third scale 163, a fourth scale 164, a fifth scale 165, and a sixth scale 166.

The first scale 161 is the calibrated scale selected from the plurality of scales 115 that measures the dose of the smoking material 181 contained in the first chamber 141. The second scale 162 is the calibrated scale selected from the plurality of scales 115 that measures the dose of the smoking material 181 contained in the second chamber 142. The third scale 163 is the calibrated scale selected from the plurality of scales 115 that measures the dose of the smoking material 181 contained in the third chamber 143. The fourth scale 164 is the calibrated scale selected from the plurality of scales 115 that measures the dose of the smoking material 181 contained in the fourth chamber 144. The fifth scale 165 is the calibrated scale selected from the plurality of scales 115 that measures the dose of the smoking material 181 contained in the fifth chamber 145. The sixth scale 166 is the calibrated scale selected from the plurality of scales 115 that measures the dose of the smoking material 181 contained in the sixth chamber 146.

The transport structure 102 is an extension structure. The transport structure 102 separates the span of the distance between the partitioned bowl 101 and the hookah 182. The transport structure 102 attaches the partitioned bowl 101 to the hookah 182. The transport structure 102 forms a fluidic connection between the partitioned bowl 101 and the hookah 182 such that when a vacuum is applied to the hookah 182 atmospheric gas will be drawn into the transport structure 102 through the partitioned bowl 101 and subsequently transported into the hookah 182. The air flow through the partitioned bowl 101 is drawn through the smoking material 181 during the combustion process. The transport structure 102 comprises a transport pipe 171 and a stabilizing disk 172. The transport structure 102 is further defined with a transport intake port 173 and a transport exhaust port 174.

The transport pipe 171 is a prism-shaped pipe. The transport pipe 171 transports the gas phase of the pharmacologically active media 183 from the partitioned bowl 101 to the smoking material 181. The stabilizing disk 172 is a disk-shaped structure. The stabilizing disk 172 forms a ring. The stabilizing disk 172 attaches the transport intake port 173 of the transport pipe 171 to the pyramid exhaust port 134 of the pyramid structure 112.

The transport intake port 173 is a first open end of the transport pipe 171. The transport intake port 173 is geometrically identical to the pyramid exhaust port 134. The transport intake port 173 attaches to the pyramid exhaust port 134. The transport intake port 173 receives the atmospheric gases through the partitioned bowl 101 into the transport pipe 171. The transport exhaust port 174 is a second open end of the transport pipe 171. The transport exhaust port 174 discharges the atmospheric gas and the gas phase of the pharmacologically active media 183 into the smoking material 181.

The following three paragraphs describe the assembly of the invention 100.

The first chamber 141 is the space formed within the hollow interior of the partitioned bowl 101 located between the sixth bulkhead 156 and the first bulkhead 151. The second chamber 142 is the space formed within the hollow interior of the partitioned bowl 101 located between the first bulkhead 151 and the second bulkhead 152. The third chamber 143 is the space formed within the hollow interior of the partitioned bowl 101 located between the second bulkhead 152 and the third bulkhead 153. The fourth chamber 144 is the space formed within the hollow interior of the partitioned bowl 101 located between the third bulkhead 153 and the fourth bulkhead 154. The fifth chamber 145 is the space formed within the hollow interior of the partitioned bowl 101 located between the fourth bulkhead 154 and the fifth bulkhead 155. The sixth chamber 146 is the space formed within the hollow interior of the partitioned bowl 101 located between the fifth bulkhead 155 and the sixth bulkhead 156.

The first scale 161 is formed on the prism exterior surface 122 of the prism structure 111 at a location opposite to the prism interior surface 121 of the first chamber 141. The second scale 162 is formed on the prism exterior surface 122 of the prism structure 111 at a location opposite to the prism interior surface 121 of the second chamber 142. The third scale 163 is formed on the prism exterior surface 122 of the prism structure 111 at a location opposite to the prism interior surface 121 of the third chamber 143. The fourth scale 164 is formed on the prism exterior surface 122 of the prism structure 111 at a location opposite to the prism interior surface 121 of the fourth chamber 144. The fifth scale 165 is formed on the prism exterior surface 122 of the prism structure 111 at a location opposite to the prism interior surface 121 of the fifth chamber 145. The sixth scale 166 is formed on the prism exterior surface 122 of the prism structure 111 at a location opposite to the prism interior surface 121 of the sixth chamber 146.

The prism exhaust port 124 of the prism structure 111 attaches to the pyramid intake port 133 of the pyramid structure 112. The pyramid exhaust port 134 of the pyramid structure 112 attaches to the transport intake port 173 of the transport pipe 171. The transport exhaust port 174 of the transport pipe 171 attaches to the hookah 182.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bowl: As used in this disclosure, a bowl is a rounded hollow structure used to store a material.

Bulkhead: As used in this disclosure, a bulkhead is a vertical barrier, often referred to as a wall, which subdivides a space into compartments.

Calibration: As used in this disclosure, a calibration refers to a standard scale that is marked on an instrument, and that is used for measurement. In its verbal form, to calibrate refers to comparing an instrument's calibration against a known and trusted standard to ensure that the calibration of the remains correct.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Combustion: As used in this disclosure, combustion refers to a reduction-oxidation reaction wherein oxygen and a hydrocarbon are combined to release energy, carbon dioxide, and water. In general usage, the meaning of combustion is often extended to describe a reaction between oxygen and a fuel source, such as a hydrocarbon modified by functional groups, which releases energy.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object. Always use Geometrically similar, correspond and one to one Correspond: As used in this disclosure, the term correspond is used as a comparison between two or more objects wherein one or more properties shared by the two or more objects match, agree, or align within acceptable manufacturing tolerances.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a prism-shaped object that is flat in appearance. Specifically, the sum of the surface areas of two ends of the prism-shaped object that forms the disk is greater than the surface area of the lateral face of the prism-shaped object that forms the disk. In this disclosure, the ends of the prism-shaped structure that forms the disk are referred to as the faces of the disk.

Dose: As used in this disclosure, the term dose refers to a specified measured quantity of a chemical substance that is to be incorporated or introduced into an organism or a mixture such as a recipe or a solution. The term dose often, but not necessarily, implies the introduction of a therapeutic substance or a pharmacologically active media into a patient.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hookah: As used in this disclosure, a hookah is a device used to distribute one or more doses of a pharmacologically active media in a gas phase. The hookah: a) provides a chamber for the combustion of a smoking material such that the smoking material will release a pharmacologically active media in a gas phase; b) transports the gas phase of the pharmacologically active media through a water-filled chamber; and, c) presents the gas phase of the pharmacologically active media to a patient for consumption.

Inner Dimension: As used in this disclosure, the term inner dimension describes the span from a first inside or interior surface of a container to a second inside or interior surface of a container. The term is used in much the same way that a plumber would refer to the inner diameter of a pipe.

Liquid: As used in this disclosure, a liquid refers to a state (phase) of matter that is fluid and that maintains, for a given pressure, a fixed volume that is independent of the volume of the container.

Loop: As used in this disclosure, a loop is the length of a first linear structure including, but not limited to, shafts, lines, cords, or ribbons, that is: 1) folded over and joined at the ends forming an enclosed space; or, 2) curved to form a closed or nearly closed space within the first linear structure.

In both cases, the space formed within the first linear structure is such that a second linear structure such as a line, cord or a hook can insert through the space formed within the first linear structure. Within this disclosure, the first linear structure is said to loop around the second linear structure.

N-gon: As used in this disclosure, an N-gon is a regular polygon with N sides wherein N is a positive integer number greater than 2.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Patient: As used in this disclosure, a patient is a person who is designated to receive a medical treatment, therapy or service. The term patient may be extended to an animal when used within the context of the animal receiving veterinary treatment or services Pharmacologically Active Media: As used in this disclosure, a pharmacologically active media refers to a chemical substance that has a biochemical or physiological effect on a biological organism.

Phase: As used in this disclosure, phase refers to the state of the form of matter. The common states of matter are solid, liquid, gas, and plasma.

Pipe: As used in this disclosure, a pipe is a hollow prism-shaped device that is suitable for use in transporting a fluid. The line that connects the center of the first base of the prism to the center of the second base of the prism is referred to as the axis of the prism or the centerline of the pipe. When two pipes share the same centerline, they are said to be aligned. In this disclosure, the terms inner dimension of a pipe and outer dimension are used as they would be used by those skilled in the plumbing arts.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular appearance. Plates often have a disk-like structure. The face of the plate is a surface of the plate selected from the group consisting of: a) the surface of the plate with the greatest surface area; b) the surface of the plate that is distal from the surface of the plate with the greatest surface area. The edges of the plate comprise the surfaces of the plate that would not be considered faces as defined above. As defined in this disclosure, plates may be made of any material, but are commonly made of metal, plastic, and wood. When made of wood, a plate is often referred to as a board or a plank.

Polygon: As used in this disclosure, a polygon refers to a closed planar figure comprising three or more sides. Any two adjacent sides selected from the three or more sides attach to each other such that the two adjacent sides form an interior arc with a cant of less than 180 degrees. A regular polygon is defined as a polygon wherein: a) the span of the length of any side selected from the three or more sides equals the span of the length of any unselected side remaining in the three or more sides; and, b) the arc of the cant between any two adjacent sides selected from the three or more sides equals the arc of the cant of any two unselected sides remaining in the three or more sides. Polygons are often referred to as N-gons where N refers to the number of sides. For example, a pentagon has five sides and a hexagon has six sides.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pyramid: As used in this disclosure, a pyramid is a three-dimensional shape that comprises a base formed in the shape of an N-gon (wherein N is an integer) with N triangular faces that rise from the base to converge at a point above the base. If the point where the N faces meet is positioned such that a line drawn from the point where the N faces meet to the center of the N-gon base is perpendicular to the N-gon base, the pyramid is referred to as a right pyramid. Pyramids can be further formed with circular or elliptical bases which are commonly referred to as cone or an elliptical pyramid respectively. A pyramid is defined with a base, an apex, and a lateral face. The base is the N-gon shaped base described above. The apex is the convergence point described above. The lateral face is formed from the N triangular faces described above.

Radial: As used in this disclosure, the term radial refers to a direction that: 1) is perpendicular to an identified central axis; or, 2) projects away from a center point.

Reduction-Oxidation Reaction: As used in this disclosure, a reduction-oxidation reaction (also known as a redox reaction) is a chemical reaction involving the transfer of electrons between the reactants of the reaction.

Ring: As used in this disclosure, a ring is a term that is used to describe a flat or plate-like structure through which an aperture is formed. Rings are often considered loops.

Scale: As used in this disclosure, refers to a visual system of ordered markings that are used as a reference for measurement.

Smoking Material: As used in this disclosure, smoking materials are combustible materials that are intended to be deeply inhaled as the smoking material burns. This definition is intended to include, but is not limited to, tobacco and materials that exhibit pharmacological activity such as marijuana. This definition is intended to include vaporizing devices commonly used to evaporate or sublimate materials into a gas phase that simulate the smoking experience. This definition is intended to exclude combustible materials that are burned as a perfume but that are generally not purposefully inhaled including, but not limited to, incense and scented oils.

Solid: As used in this disclosure, a solid refers to a state (phase) of matter that: 1) has a fixed volume; and, 2) does not flow.

Therapeutic: As used in this disclosure, therapeutic is an adjective that refers to a medical, ameliorative, or hygienic substance, process, or procedure.

Vacuum: As used in this disclosure, a vacuum is used to describe a first space that contains gas at a reduced gas pressure relative to the gas pressure of a second space. If the first space and the second space are connected together, this pressure differential will cause gas from the second space to move towards the first space until the pressure differential is eliminated.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An accessory for a narghile comprising:
a partitioned bowl and a transport structure;
wherein the accessory for a narghile is configured for use with a hookah;
wherein the transport structure forms a fluidic connection between the partitioned bowl and the hookah;
wherein the accessory for a narghile is configured for use with a smoking material;
wherein the accessory for a narghile contains the smoking material during a combustion process;
wherein the combustion of the smoking material releases a pharmacologically active media in a gas phase;
wherein the transport structure transports the gas phase of the pharmacologically active media from the partitioned bowl to the hookah;
wherein the accessory for a narghile is a partitioned structure;
wherein the accessory for a narghile is configured to store a plurality of doses of the smoking material;
wherein each dose is stored in a partition;
wherein the partitioned bowl is the partitioned structure that contains one or more doses of the smoking material;
wherein each partition displays a scale that measures the dose of the smoking material contained in the partition;
wherein the partitioned bowl comprises a prism structure, a pyramid structure, and a plurality of bulkheads;
wherein the pyramid structure attaches to the prism structure;
wherein the hollow interior of the partitioned bowl contains the plurality of bulkheads;
wherein the prism structure is further defined with a prism interior surface, a prism exterior surface, a prism intake port, and a prism exhaust port;
wherein the pyramid structure is further defined with a pyramid interior surface, a pyramid exterior surface, a pyramid intake port, and a pyramid exhaust port;
wherein each of the plurality of bulkheads is a plate;
wherein each of the plurality of bulkheads forms a plane that contains the center axis of the composite prism that forms the partitioned bowl;
wherein each of the plurality of bulkheads forms a fluid impermeable barrier that extends from the center axis of the partitioned bowl to the prism interior surface of the prism structure;
wherein each of the plurality of bulkheads forms a fluid impermeable barrier that extends from the center axis of the partitioned bowl to the pyramid interior surface of the pyramid structure.

2. The accessory for a narghile according to claim 1
wherein the partitioned bowl is a hollow structure;
wherein the partitioned bowl has the shape of a composite prism.

3. The accessory for a narghile according to claim 2 wherein each of the partitions formed within the partitioned bowl forms a partitioned storage space such that the smoking material can be segregated into a plurality of independently stored doses.

4. The accessory for a narghile according to claim 3 wherein each separate dose contained in the partitioned bowl is consumed independently of other separate doses contained within the partitioned bowl.

5. The accessory for a narghile according to claim 4
wherein the transport structure is an extension structure;
wherein the transport structure separates the span of the distance between the partitioned bowl and the hookah;
wherein the transport structure attaches the partitioned bowl to the hookah;
wherein the transport structure forms a fluidic connection between the partitioned bowl and the hookah such that when a vacuum is applied to the hookah, atmospheric gas will be drawn into the transport structure through the partitioned bowl and subsequently transported into the hookah;
wherein the air flow through the partitioned bowl is drawn through the smoking material during the combustion process.

6. The accessory for a narghile according to claim 5 wherein the prism structure and the pyramid structure are joined to form a composite prism shape.

7. The accessory for a narghile according to claim 6 wherein the prism structure is a hollow prism-shaped structure;
wherein the prism structure forms a fluid flow structure that transports atmospheric gases into the pyramid structure.

8. The accessory for a narghile according to claim 7
wherein the pyramid structure is a hollow structure;
wherein the pyramid structure has the shape of a truncated pyramid;
wherein the pyramid structure forms a fluid flow structure that transports atmospheric gases from the prism structure to the transport structure.

9. The accessory for a narghile according to claim 8
wherein the plurality of bulkheads forms a plurality of chambers within the partitioned bowl;
wherein each of the plurality of bulkheads forms a solid surface such that any two adjacent bulkheads selected from the plurality of bulkheads isolate a chamber selected from the plurality of chambers from the chambers remaining in the plurality of chambers.

10. The accessory for a narghile according to claim 9
wherein each of the plurality of chambers is a segregated storage space formed in the partitioned bowl;
wherein each of the plurality of chambers stores a dose of the smoking material;
wherein each of the plurality of chambers contains the dose of the smoking material during the combustion process used to release the gas phase of the pharmacologically active media;
wherein each of the plurality of chambers is bounded by the prism interior surface, the pyramid interior surface and two adjacent bulkheads selected from the plurality of bulkheads;
wherein the construction of each of the plurality of chambers is such that each dose of the smoking material consumed independently while the remaining doses of the smoking material remain in storage.

11. The accessory for a narghile according to claim 10
wherein each of the plurality of chambers further comprises a plurality of scales;
wherein each of the plurality of scales is a calibrated set of markings;
wherein there is a one to one correspondence between each scale selected from the plurality of scales and an associated chamber selected from the plurality of chambers;
wherein each of the plurality of scales provides a volumetric measure the dose of the smoking material contained within the associated chamber.

12. The accessory for a narghile according to claim 11
wherein the prism intake port is a first open end of the prism structure;
wherein the prism intake port is the end of the prism structure that is distal from the pyramid structure;
wherein the prism exhaust port is a second open end of the prism structure;
wherein the prism exhaust port is the end of the prism structure that attaches to the pyramid structure;
wherein the pyramid intake port refers to the open base of the pyramid structure;
wherein the pyramid intake port is the end of the pyramid structure that attaches to the prism exhaust port of the prism structure;
wherein the pyramid exhaust port refers to the open truncated apex of the truncated pyramid shape of the pyramid structure;
wherein the pyramid intake port of the pyramid structure is geometrically identical to the prism exhaust port of the prism structure;
wherein the pyramid exhaust port is the end of the pyramid structure that is distal from the prism structure.

13. The accessory for a narghile according to claim 12 wherein the prism structure has the shape of a hexagonal polygon.

14. The accessory for a narghile according to claim 13
wherein the plurality of bulkheads comprises a first bulkhead, a second bulkhead, a third bulkhead, a fourth bulkhead, a fifth bulkhead, and a sixth bulkhead;
wherein the first bulkhead is the bulkhead selected from the plurality of bulkheads that forms a barrier between the sixth chamber and the first chamber;
wherein the second bulkhead is the bulkhead selected from the plurality of bulkheads that forms a barrier between the first chamber and the second chamber;
wherein the third bulkhead is the bulkhead selected from the plurality of bulkheads that forms a barrier between the second chamber and the third chamber;
wherein the fourth bulkhead is the bulkhead selected from the plurality of bulkheads that forms a barrier between the third chamber and the fourth chamber;
wherein the fifth bulkhead is the bulkhead selected from the plurality of bulkheads that forms a barrier between the fourth chamber and the fifth chamber;
wherein the sixth bulkhead is the bulkhead selected from the plurality of bulkheads that forms a barrier between the fifth chamber and the sixth chamber.

15. The accessory for a narghile according to claim 14
wherein the plurality of chambers comprises a first chamber, a second chamber, a third chamber, a fourth chamber, a fifth chamber, and a sixth chamber;
wherein the first chamber is the chamber selected from the plurality of chambers located between the sixth chamber and the second chamber;
wherein the second chamber is the chamber selected from the plurality of chambers located between the first chamber and the third chamber;
wherein the third chamber is the chamber selected from the plurality of chambers located between the second chamber and the fourth chamber;
wherein the fourth chamber is the chamber selected from the plurality of chambers located between the third chamber and the fifth chamber;
wherein the fifth chamber is the chamber selected from the plurality of chambers located between the fourth chamber and the sixth chamber;
wherein the sixth chamber is the chamber selected from the plurality of chambers located between the fifth chamber and the first chamber.

16. The accessory for a narghile according to claim 15
wherein the plurality of scales comprises a first scale, a second scale, a third scale, a fourth scale, a fifth scale, and a sixth scale;
wherein the first scale is the calibrated scale selected from the plurality of scales that measures the dose of the smoking material contained in the first chamber;
wherein the second scale is the calibrated scale selected from the plurality of scales that measures the dose of the smoking material contained in the second chamber;
wherein the third scale is the calibrated scale selected from the plurality of scales that measures the dose of the smoking material contained in the third chamber;
wherein the fourth scale is the calibrated scale selected from the plurality of scales that measures the dose of the smoking material contained in the fourth chamber;
wherein the fifth scale is the calibrated scale selected from the plurality of scales that measures the dose of the smoking material contained in the fifth chamber;
wherein the sixth scale is the calibrated scale selected from the plurality of scales that measures the dose of the smoking material contained in the sixth chamber.

17. The accessory for a narghile according to claim 16
wherein the transport structure comprises a transport pipe and a stabilizing disk;
wherein the transport structure is further defined with a transport intake port and a transport exhaust port;
wherein the transport pipe is a prism-shaped pipe;
wherein the stabilizing disk is a disk-shaped structure;
wherein the stabilizing disk forms a ring;
wherein the stabilizing disk attaches the transport intake port of the transport pipe to the pyramid exhaust port of the pyramid structure;
wherein the transport intake port is a first open end of the transport pipe;

wherein the transport intake port is geometrically identical to the pyramid exhaust port;

wherein the transport intake port attaches to the pyramid exhaust port;

wherein the transport exhaust port is a second open end of the transport pipe.

18. The accessory for a narghile according to claim 17 wherein the first chamber is the space formed within the hollow interior of the partitioned bowl located between the sixth bulkhead and the first bulkhead;

wherein the second chamber is the space formed within the hollow interior of the partitioned bowl located between the first bulkhead and the second bulkhead;

wherein the third chamber is the space formed within the hollow interior of the partitioned bowl located between the second bulkhead and the third bulkhead;

wherein the fourth chamber is the space formed within the hollow interior of the partitioned bowl located between the third bulkhead and the fourth bulkhead;

wherein the fifth chamber is the space formed within the hollow interior of the partitioned bowl located between the fourth bulkhead and the fifth bulkhead;

wherein the sixth chamber is the space formed within the hollow interior of the partitioned bowl located between the fifth bulkhead and the sixth bulkhead;

wherein the first scale is formed on the prism exterior surface of the prism structure at a location opposite to the prism interior surface of the first chamber;

wherein the second scale is formed on the prism exterior surface of the prism structure at a location opposite to the prism interior surface of the second chamber;

wherein the third scale is formed on the prism exterior surface of the prism structure at a location opposite to the prism interior surface of the third chamber;

wherein the fourth scale is formed on the prism exterior surface of the prism structure at a location opposite to the prism interior surface of the fourth chamber;

wherein the fifth scale is formed on the prism exterior surface of the prism structure at a location opposite to the prism interior surface of the fifth chamber;

wherein the sixth scale is formed on the prism exterior surface of the prism structure at a location opposite to the prism interior surface of the sixth chamber;

wherein the prism exhaust port of the prism structure attaches to the pyramid intake port of the pyramid structure;

wherein the pyramid exhaust port of the pyramid structure attaches to the transport intake port of the transport pipe;

wherein the transport exhaust port of the transport pipe attaches to the hookah.

* * * * *